United States Patent [19]

Haeussler

[11] 4,005,592

[45] Feb. 1, 1977

[54] STRIP AND WIRE STRAIGHTENER ROLL

[76] Inventor: Alfred H. K. Haeussler, 5841 W. 107th St., Chicago Ridge, Ill. 60415

[22] Filed: Dec. 12, 1975

[21] Appl. No.: 640,394

[52] U.S. Cl. ..... 72/165

[51] Int. Cl.[2] ..... B21F 1/02

[58] Field of Search ..... 72/160, 165; 140/147

[56] References Cited

UNITED STATES PATENTS

| | | | |
|---|---|---|---|
| 2,293,156 | 8/1942 | Mason | 72/164 X |
| 2,295,017 | 9/1942 | Shields | 72/163 |
| 2,323,768 | 7/1943 | Hanna | 72/165 |
| 2,852,065 | 9/1958 | Peterson | 72/164 |
| 3,326,026 | 6/1967 | Guillot | 72/163 |
| 3,605,471 | 9/1971 | Bodtke | 72/165 |
| 3,704,614 | 12/1972 | Keyser | 72/165 |
| 3,834,202 | 9/1974 | Kawaguchi et al. | 72/163 |

FOREIGN PATENTS OR APPLICATIONS

| | | | |
|---|---|---|---|
| 35,836 | 11/1929 | France | 72/164 |

*Primary Examiner*—Milton S. Mehr

[57] ABSTRACT

A straightening attachment for a wire or strip processing machine, the attachment consisting of a fixed bottom block member of upwardly facing U-shaped cross section, a plurality of longitudinally spaced peripherally grooved bottom rollers journaled in the bottom block member, the bottom block member having upstanding apertured end post elements, a floating block member slidably engaged with the post members and having transverse rectangular notches slidably containing downwardly facing yoke members having transversely aligned notches in which are engaged shaft elements carrying upper peripherally grooved pressure rollers staggered relative to the bottom rollers and longitudinally aligned therewith, a pressure arm pivotally engaged with the top end of one of the post members and having depending rod elements threadedly engaged therewith and being connected to the respective yoke members, an upstanding arm on the end of the floating block member opposite the pivot connection of the pressure arm and extending through a slot in the pressure arm, and a camming lever eccentrically pivoted to the top end of said upstanding arm and having cam portions engageable with the pressure arm to exert manually controllable force on the pressure arm to control the straightening force on a wire or strip being pulled longitudinally between the upper and lower sets of peripherally grooved rollers. Cushioning springs are provided between the floating block member and the bottom block member. A horizontally-acting multi-roller straightening assembly is provided ahead of and longitudinally aligned with the vertically-acting straightening assembly.

20 Claims, 6 Drawing Figures

STRIP AND WIRE STRAIGHTENER ROLL

The invention relates to wire or strip straightening devices, and more particularly to wire or strip straightening attachments of the type employing opposed sets of peripherally grooved pressure rollers exerting straightening pressure on a wire or strip being pulled therebetween.

A main object of the invention is to provide a novel and improved wire or strip straightening device which is relatively simple in construction, which is compact in size, which is smooth in operation, and which is controllable to provide the proper straightening force to be exerted on a wire or strip being pulled through the device.

A further object of the invention is to provide an improved wire or strip straightening device which is inexpensive to fabricate, which is rugged in construction, and which is easily adjustable to different sizes of wire or strip to be straightened.

A still further object of the invention is to provide an improved wire or strip straightening device of the type employing opposed sets of pressure rollers between which a wire or strip to be straightened is pulled, the device having manually operable force-transmitting means which can be controlled to readily vary the straightening force applied to a wire or strip passing between the opposed sets of pressure rollers.

A still further object of the invention is to provide an improved wire or strip straightening device wherein a wire or strip pulled through the device can be straightened both in a horizontal plane and in a vertical plane, the device including means to control the straightening pressure, at the discretion of the operator, at least in one of said planes, and being readily adjustable to handle a wide range of sizes of wire or strip material to be straightened.

Further objects and advantages of the invention will become apparent from the following description and claims, and from the accompanying drawings, wherein:

Figure 1:
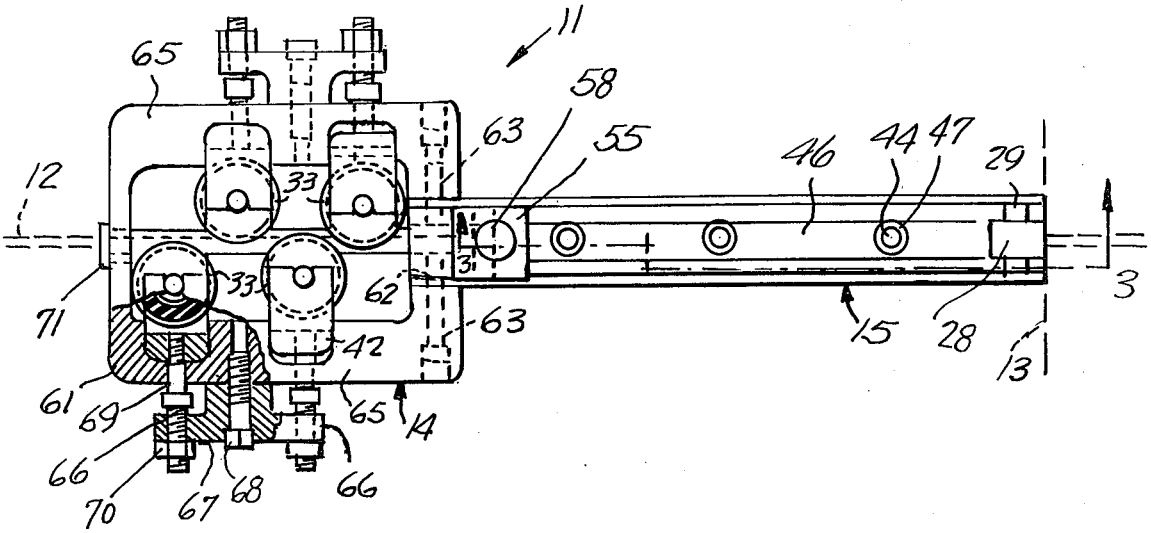
FIG. 1 is a top plan view, partly in horizontal cross section, of an improved wire or strip straightening device constructed in accordance with the present invention.

Referring to the drawings, 11 generally designates an improved wire or strip straightening attachment according to the present invention, the attachment being intended for use to straighten, for example, a wire 12 being pulled by and into a wire processing machine 13 which cuts, forms, or otherwise suitably processes the wire. The wire 12 is supplied from a supply spool or other wire storage device, not shown, from which the wire is fed in an arcuately curved or otherwise non-linear condition, for example, curved mainly in a vertical plane, whereby the required straightening action is mostly in such vertical plane.

The straightening device 11 is rigidly secured to the processing machine 13 in any suitable manner to guide the wire in its required direction toward the processing machine. The device 11 comprises a forward section 14, for straightening the wire in a horizontal plane, and a rearward section 15 for straightening the wire in a vertical plane, wherein, as above mentioned, the major straightening action may be required.

The rearward straightening section 15 comprises a bottom fixed block member, designated generally at 16. The bottom block member 16 comprises a longitudinal base bar 17 to the side edges of which are rigidly secured, as by transverse bolts 19, respective upstanding side plates 18, 18 forming a body of upwardly facing U-shaped cross-section. Rigidly secured between the end portions of the side plates 18, 18, by transverse bolts 20, are the respective front and rear upstanding end post members 21 and 22, apertured respectively at 23 and 24 to define longitudinally aligned passageways for the wire 12. Post member 21 is formed with an integral rearwardly directed top flange 25 in which is threadedly engaged an upstanding eye bolt 26 locked in vertically adjusted position by a locknut 27. Post member 22 has a reduced top end lug 28 provided with opposite transversely extending coaxial pivot lugs 29, 29.

Figure 6:
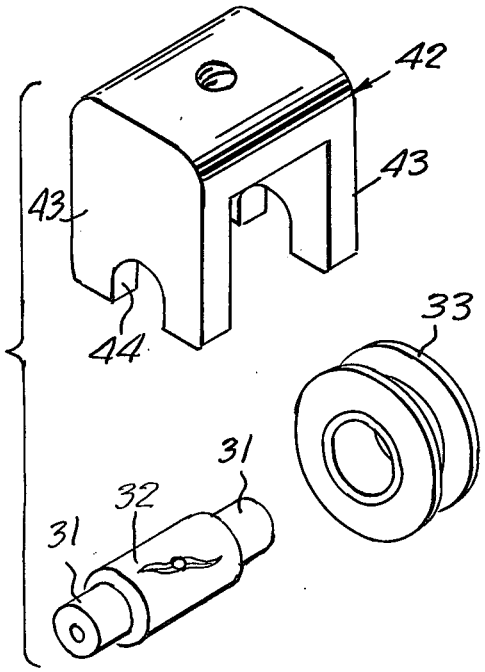
FIG. 6 is a perspective view showing one of the yoke members and the associated roller shaft and pressure roller employed therewith in the straightening device of FIG. 1 to 5.

The side plates 18, 18 are formed with spaced pairs of transversely aligned upwardly opening vertical slots 30, 30 in which are rotatably received the opposite reduced end portions 31, 31 of transverse roller shafts 32 (see FIG. 6) on which are secured respective peripherally grooved bottom pressure rollers 33, forming bottom rolling supports for the wire 12, as will be presently described.

Figure 5:
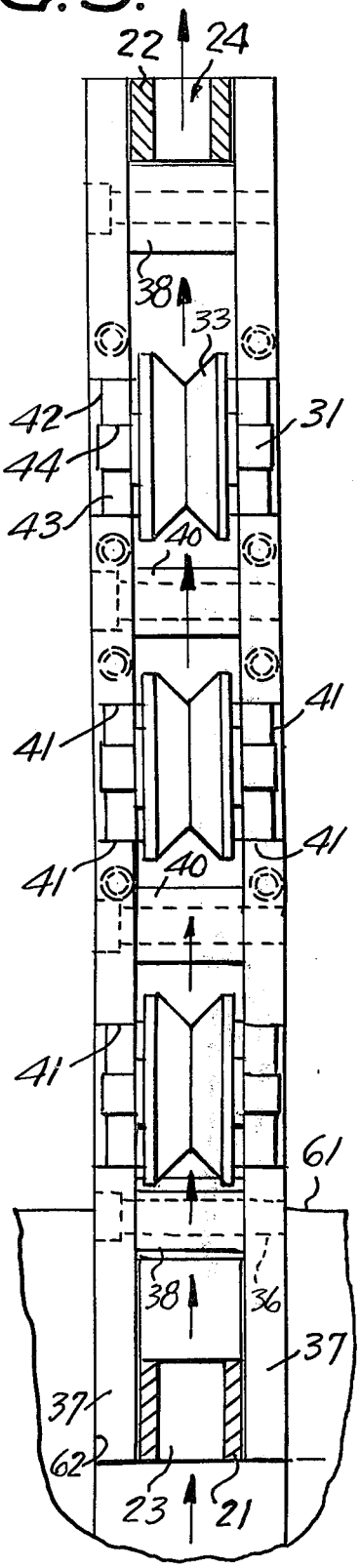
FIG. 5 is a horizontal cross-sectional view taken substantially on line 5—5 of FIG. 4.

Designated generally at 34 is a floating block member comprising a longitudinally extending center block 35 to which are rigidly secured, as by transverse bolts 36, respective side plates 37, 37 with spacer blocks 38, 38 secured between the end portions of the side plates 37, 37 and with additional spacer blocks 40, 40 similarly secured between intermediate portions of said side plates. The side plates 37, 37 project beyond the end spacer blocks 38 and slidably receive the end post members 21 and 22 therebetween, as shown in FIG. 5.

The side plates 37, 37 are formed with substantially rectangular transversely aligned downwardly facing pairs of notches 41, 41 which are longitudinally staggered relative to the bottom rollers 33, and slidably engaged in the pairs of notches 41, 41 are respective transverse yoke members 42 (see FIG. 6) having depending end legs 43, 43 formed with transversely aligned downwardly facing notches 44 having rounded upper ends formed to conformably engage with the reduced end portions 31, 31 of additional transverse shafts 32 on which are secured top rollers 33 identical with the previously described bottom rollers. Threadedly secured rigidly to the top walls of the yoke members 42 are upstanding connecting rod elements 44 which extend loosely through apertures 45 in center block 35 and which are threadedly engaged through a pressure arm 46 and are rigidly locked thereto by locknuts 47. Pressure transmitting nut members 48 are adjustably threaded on the upper portions of the rod elements 44 above the center block 35 (see FIG. 3).

The pressure arm 46 has spaced parallel upwardly facing hook-shaped rear end lugs 49, 49 which rotatably engage beneath the pivot lugs 29, 29 on opposite sides of the upstanding lug 28. At its forward end the arm 46 is formed with an open-ended slot 50 which slidably receives the eye bolt 26. A coiled spring 51 is vertically mounted in a recess 52 in block 35, bearing between the rear portion of arm 46 and block 35. Cushioning coiled springs 53 are similarly mounted in top edge recesses 54 in side plates 18, bearing between said side plates 18 and the bottom edges of the side plates 37, 37 of floating block member 34, as shown in FIG. 3.

A downwardly facing U-shaped camming yoke 55 is eccentrically pivotally connected to eye bolt 26 by a transverse pivot pin 56 extending through the eye 57 of the eye bolt. Threadedly secured to the yoke 55 is an upstanding lever arm 58. The camming lever assembly defined by yoke 55 and arm 58 is biased to a vertical position by the action of springs 51 and 53, namely, to a position wherein the flat bottom edge portions of the depending arms of yoke 55 flatly engage on the forward segments of the slotted end portion of arm 46 on opposite sides of slot 50.

Figure 3:
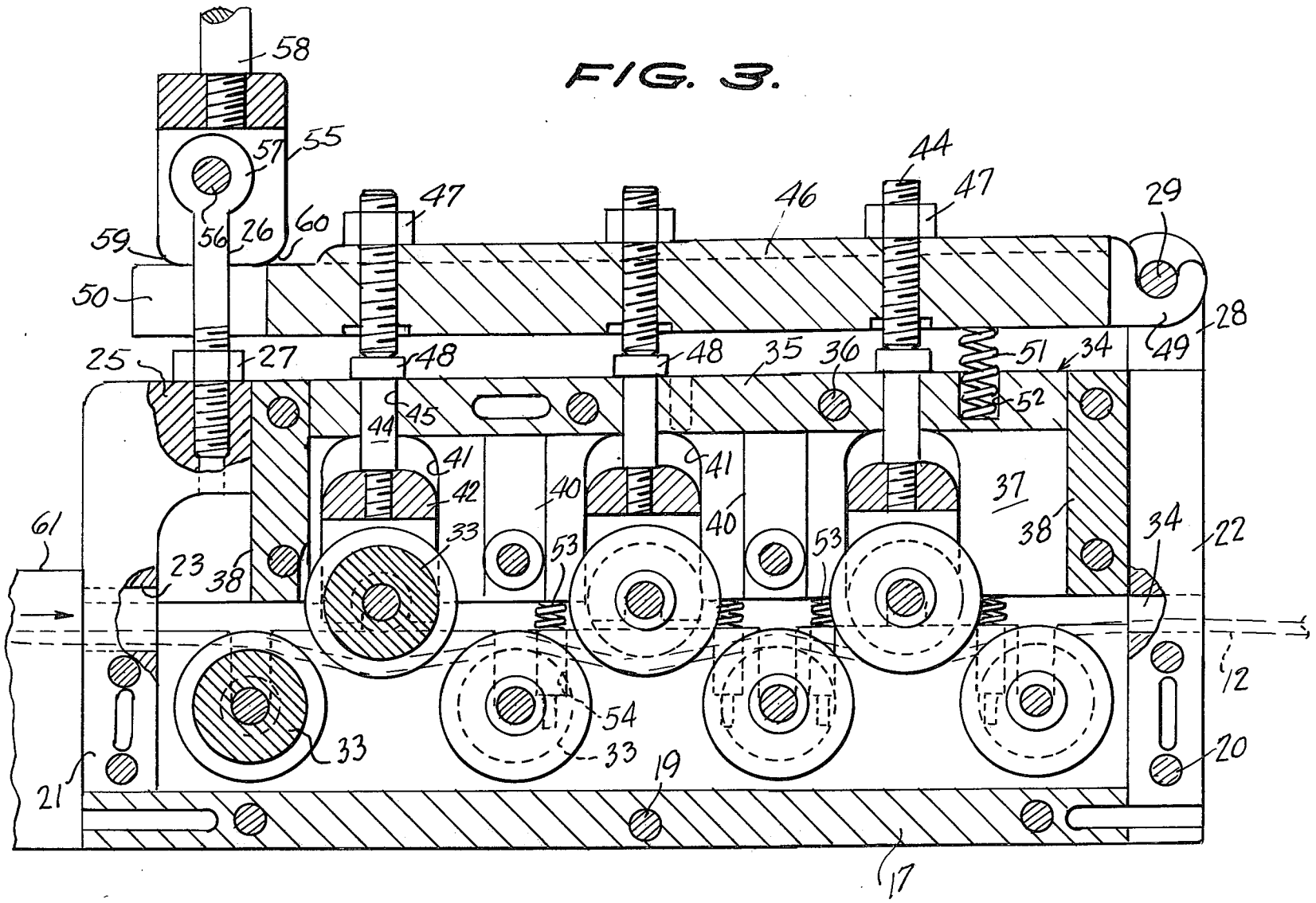
FIG. 3 is an enlarged longitudinal cross-sectional view taken substantially on line 3—3 of FIG. 1.
Figure 4:
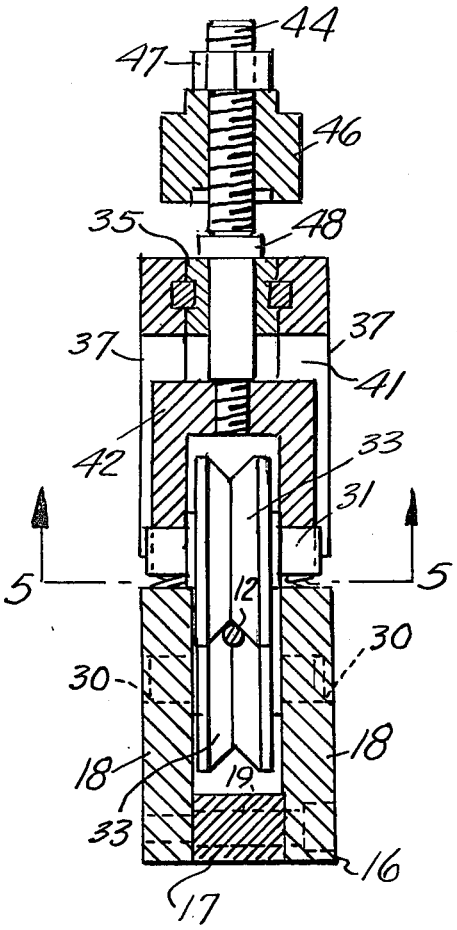
FIG. 4 is an enlarged transverse vertical cross-sectional view taken substantially on line 4—4 of FIG. 2.

The depending arms of yoke 55 have rounded forward and rear corner portions 59 and 60 to cammingly engage with arm 46 with different degrees of camming force depending upon whether lever arm 58 is rotated counterclockwise or clockwise from its normal upstanding position, as viewed in FIG. 3.

The amount of downward excursion of floating block member 34 caused by rotation of lever arm 58 can be adjusted by adjusting the stop nuts 48, in accordance with the size of the wire or strip to be straightened.

In operation, the wire or strip is pulled between the cooperating staggered bottom and top peripherally grooved rollers 33, and the lever arm 58 is manually rotated to provide a suitable amount of slight vertical deformations of the tensioned moving wire or strip so as to work it sufficiently to remove the initial curvature or non-linearity thereof.

Figure 2:
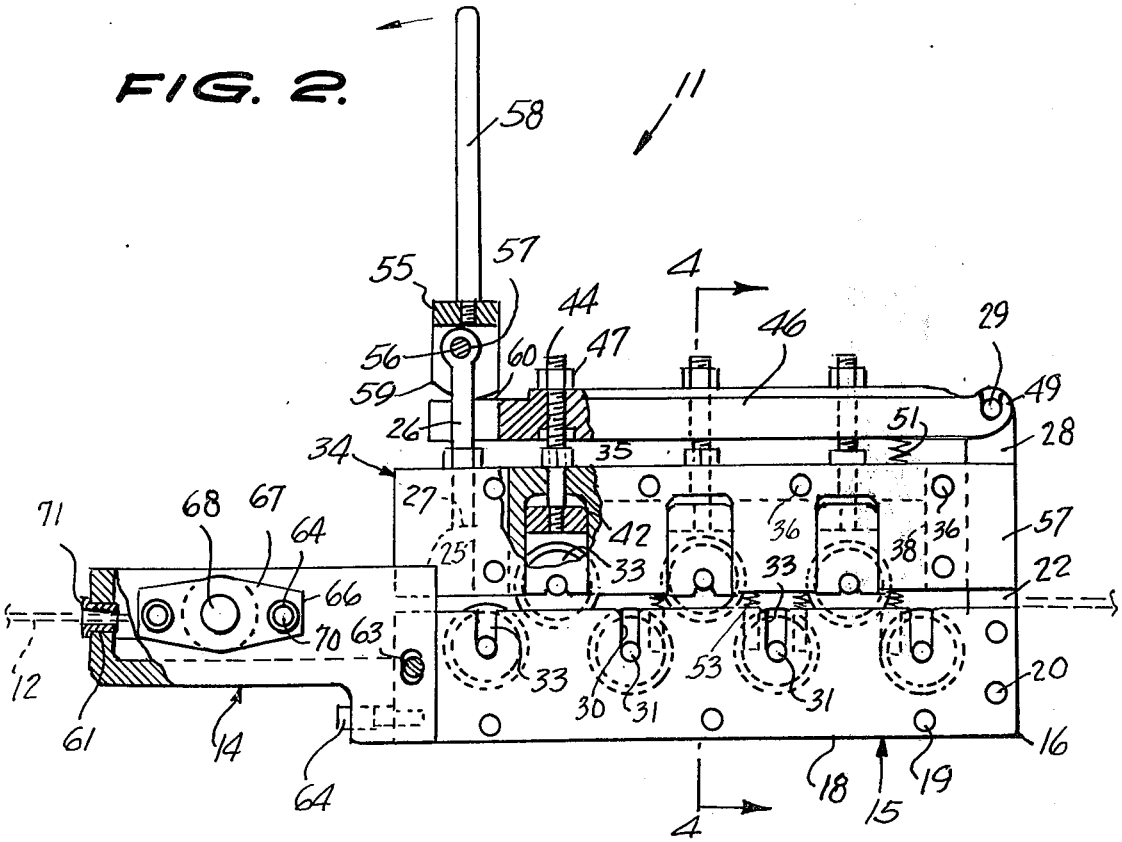
FIG. 2 is a front elevational view, partly in vertical cross section, of the straightening device of FIG. 1.

The forward straightening section 14 is designed to provide adjustable straightening action in a horizontal plane. Section 14 comprises a horizontally oriented frame 61 recessed at 62 to receive the forward end of fixed block member 16 and rigidly secured thereto by transverse bolts 63, 63 and by one or more longitudinal bottom bolts 64, as shown in FIG. 2. The frame 61 has opposite longitudinal side arms 65, 65 notched to slidably receive inwardly directed vertically oriented yoke members 42 in which are journalled horizontally-acting straightening peripherally grooved rollers 33, the yoke members of the opposite side arms 65 being staggered, as shown in FIG. 1. The yoke members are connected to the respective flanges 66 of respective T-shaped bracket members 67 rigidly secured by transverse bolts 68 to the respective side arms 65. Transverse yoke-connecting bolts 69 are threadedly rigidly secured to the vertically oriented yoke members 42, pass slidably through the side arms 65, and are adjustably threadedly engaged through the flanges 66, being locked in adjusted positions by locknuts 70. The transverse bolts 69 are adjusted to provide the estimated amount of horizontal wire or strip working action required to remove the initial horizontal non-linearity of the wire or strip being pulled through the device. An inlet guide bushing 71 is provided at the forward end of frame 61, aligned with the axis of travel of the wire or strip through the device, namely, aligned with the inlet aperture 23 of member 21.

It should be noted that the described construction provides wire or strip staightening rollers having protruding axle ends received in yoke shaped movable bearings, which exert pressure on the center of and cause even wear on the rollers and thereby prevent breaking or bending of the roller axles. This is highly advantageous and represents a substantial improvement over conventional wire straighteners in which the rollers are supported at one side, or end, only.

While a specific embodiment of an improved wire or strip straightening device has been disclosed in the foregoing description, it will be understood that various modifications within the spirit of the invention may occur to those skilled in the art. Therefore it is intended that no limitations be placed on the invention except as defined by the scope of the appended claims.

What is claimed is:

1. A straightening device for an elongated member comprising a fixed longitudinally elongated bottom support, upstanding post means on said bottom support, a plurality of spaced peripherally grooved bottom vertical rollers journalled transversely in said bottom support, a longitudinally extending block member overlying said bottom support and slidably engaging said upstanding post means, a pressure bar member pivoted to said upstanding post means and overlying said block member, said block member being formed with vertical guide means staggered relative to said bottom rollers, roller-positioning means in said guide means, respective peripherally grooved top vertical rollers rotatably engaged with the bottom ends of the positioning means, means connecting said roller positioning means to said pressure bar member, and means to exert downward force on said pressure bar member.

2. The straightening device of claim 1, and wherein said downward force-exerting means comprises cam means engaging said pressure bar member from above, means rotatably connecting said cam means to said bottom support, and means to rotate said cam means.

3. The straightening device of claim 2, and wherein said pressure bar member is formed with a slot and said last-named connecting means extends through said slot.

4. The straightening device of claim 1, and wherein said roller-positioning means comprises respective downwardly-facing U-shaped yoke members having transversely aligned bottom edge notches, said top rollers having end shaft elements rotatably engaged with said bottom edge notches.

5. The straightening device of claim 4, and wherein the means connecting the roller-positioning means to the pressure bar member comprises respective rod elements secured to the yoke members and the pressure bar member and extending movably through said block member.

6. The straightening device of claim 5, and adjustable stop means on the rod elements between the pressure bar member and the block member.

7. The straightening device of claim 6, and wherein said stop means comprises nut members threadedly engaged on the rod elements.

8. The straightening device of claim 7, and wherein said downward force-exerting means comprises an upstanding member on the post means, said pressure bar member having a slot receiving said upstanding member, and lever means pivoted to the top end of said upstanding member and being provided with a cam element engaging said pressure bar member from above.

9. The straightening device of claim 8, and spring means bearing between said bottom support and said longitudinally extending block member.

10. The straightening device of claim 9, and further spring means bearing between said block member said pressure bar member.

11. The straightening device of claim 1, and wherein said upstanding post means comprises respective upstanding post elements on the opposite ends of said elongated bottom support, said block member being formed with means to slidably receive said upstanding post elements and to guide the block member vertically.

12. The straightening device of claim 11, and wherein said means to exert downward force in said pressure bar member comprises a cam lever connected to one of said post elements and being formed to cammingly engage the pressure bar member from above.

13. The straightening device of claim 11, and wherein the free end of the pivoted pressure bar member is formed with a slot adjacent one of said post elements, and wherein the means to exert downward force on said pressure bar member comprises an upstanding element on said one post element extending upwardly through said slot, and a cam lever pivoted to the top end of said upstanding element and having a cam engaging the top surface of the pressure bar member.

14. The straightening device of claim 13, and spring means biasing the pressure bar member upwardly against said cam.

15. The straightening device of claim 14, and wherein the roller-positioning means comprises respective downwardly-facing U-shaped yoke members having transversely aligned bottom edge notches, said top rollers having shaft means rotatably engaged with said bottom edge notches.

16. The straightening device of claim 15, and wherein said spring means includes a plurality of longitudinally spaced springs bearing between said bottom support and said longitudinally extending block member and at least one further spring bearing between said block member and said pressure bar member.

17. The straightening device of claim 1, and horizontally-acting straightening means connected to one end of said bottom support.

18. The straightening device of claim 17 and wherein said horizontally-acting straightening means comprises horizontal frame means, a plurality of peripherally grooved co-planar horizontal rollers journalled to and extending inwardly from each longitudinal side of said frame means and being staggered longitudinally, the inner end portions of the horizontal rollers being substantially in alignment with the inner end portions of the vertical rollers.

19. The straightening device of claim 18, and wherein said horizontal rollers are provided with transversely adjustable positioning means.

20. The straightening device of claim 18 and wherein said last-named positioning means comprises respective U-shaped bearing yokes slidably mounted in said frame means on opposite sides thereof and having vertically aligned edge notches, the horizontal rollers having opposite vertical end shaft elements rotatably engaged with said vertically aligned edge notches, and means to adjust the positions of said U-shaped bearing yokes transversely relative to said opposite sides of the horizontal frame means.

* * * * *